United States Patent [19]

Corrette

[11] 4,034,586

[45] July 12, 1977

[54] THREAD ROLLING DIE AND METHOD OF THREAD ROLLING

[75] Inventor: Richard H. Corrette, Olmsted Falls, Ohio

[73] Assignee: Colt Industries Operating Corporation, West Hartford, Conn.

[21] Appl. No.: 689,588

[22] Filed: May 24, 1976

[51] Int. Cl.[2] ..... B21D 13/04

[52] U.S. Cl. ..... 72/88; 72/469; 10/155 A

[58] Field of Search ..... 72/469, 88, 90; 10/155 A

[56] References Cited

U.S. PATENT DOCUMENTS

| | | | |
|---|---|---|---|
| 2,283,494 | 5/1942 | Erdmon | 10/158 A X |
| 2,371,463 | 3/1945 | Olson | 72/469 |
| 3,538,739 | 11/1970 | Orlonoski | 72/469 |

*Primary Examiner*—Milton S. Mehr

*Attorney, Agent, or Firm*—McNenny, Pearne, Gordon, Gail, Dickinson & Schiller

[57] ABSTRACT

A thread rolling die and a method of thread rolling is disclosed for producing the annular rib on a threaded fastener suitable for retaining washers, clips or the like. The ends of the threads adjacent to such rib blend to the root diameter of the thread. The annular rib is produced by axially displacing workpiece material from the adjacent end of the thread. The die for rolling the thread is formed with thread forming grooves which extend to a base line spaced from the parallel to the lateral side of the die. At the base line the thread forming grooves fade to zero depth. Positioned between the base line and the lateral side of the die is a rib of increasing width which functions to displace material axially into the required rib.

13 Claims, 8 Drawing Figures

THREAD ROLLING DIE AND METHOD OF THREAD ROLLING

BACKGROUND OF THE INVENTION

This invention relates generally to thread rolling and more particularly to a novel and improved method rolling a threaded fastener having an annular ridge suitable for retaining a washer, clip or the like, and to a novel and improved die for performing such method.

PRIOR ART

It is known to assemble a washer, a clip or the like on a blank for a threaded fastener, usually against its head, and to then roll a thread on the blank. During the rolling operation the blank diameter increases along the threads and therefore the threads function to retain the washer or clip in position. In some instances, however, the clip or washer tends to engage the ends of the threads and is jammed or locked so that the fastener cannot freely turn within the washer or clip. In other instances the washer or clip tends to tip in a manner allowing it to rotate down along the threads until it is substantially spaced from its desired position or is threaded off of the fastener.

In order to overcome these problems the thread rolling operation is sometimes arranged to produce an annular rib or shoulder to secure the washer or clip in position. This has been done in some instances by clamping a thin metal blade against the top edge of the die in position to form an annular groove adjacent to the head end of the threads. When the groove is formed by the blade, blank material is displaced to form the annular rib beneath the washer or clip and functions to retain the washer or clip in position.

Difficulty is encountered with such blade assemblies. First, it is difficult to properly position and retain the blade. Also, if the thread groove shape is extended to the edge of the die adjacent to the blade, the thread convolutions have very thin sections at their ends which tend to break or chip causing rapid die deterioration. Also, the intersection of such thread grooves with the blade forms narrow or thin pockets which do not uniformly fill and the ends of the threads tend to be ragged, jagged or have unduly sharp edges.

If the ends of the thread grooves adjacent to the blade are ground or chamfered to eliminate the breakage or chipping other problems are encountered. In such case an annular rib is formed on both sides of the groove produced by the blade and the end of the thread is not uniform. The annular ridge remote from the head tends to jam when the fastener is threaded in a female threaded part and sometimes prevents full tightening of the fastener.

SUMMARY OF THE INVENTION

In accordance with the present invention a novel and improved die is provided for rolling threads in a blank and for simultaneously producing an annular rib suitable, for example, for retaining a washer, clip or the like. The threads extend to an end where the thread form blends down to the root diameter to provide the threads with well defined and smooth ends. Spaced from the ends of the thread by a small distance is an annular rib which is formed by displacing the material of the blank substantially to the root diameter of the thread and causing axial displacement of such material into the required rib.

The illustrated die is provided with the usual thread convolutions which extend to a base line parallel to the lateral edge of the die and are tapered to zero depth at such base line. Located between the base line and the lateral edge of the die is an unthreaded ridge which operates to produce an annular groove extending from the ends of the thread. Such ridge on the die functions to displace the blank material to form the annular rib on the fastener which functions to retain the washer or clip in position.

In the preferred embodiment the die is chamfered in an angulated manner so that the side of the groove forming ridge on the die is inclined toward the top edge of the die to cause a continued axial displacement of the blank material to form the annular rib. Because the thread grooves fade to zero depth at a location spaced from the edge of the die, thin weakened sections do not exist and the tendency for the die to chip or break is eliminated. Also, the structure of the thread forming grooves, which includes the ends, which fade gradually to zero depth, insures tht the ends of the threads are smoothly formed and fully filled. Further, since the rib forming ridge joins the ends of the thread forming grooves the annular groove adjacent to the ends of the threads is produced without a secondary rib on the finished part at the ends of the threads. Consequently, the finished part can be threaded into a mating part all the way to the rib which is provided to lock the washer or clip. Finally, because the die is an integral structure, it is not necessary to attempt to position two working parts with respect to each other and there is no danger of slippage between two parts of type used in the prior art.

In accordance with another aspect of this invention, a method is provided in which blank material is displaced from the zone at the ends of the threads axially of the blank to produce an axial flow of blank material into the required annular rib. Such axial displacement produces a more sharply defined rib which can if required have a relatively large diameter. In accordance with this method the die is provided with a ridge which initially has very little width and wherein the width increases toward the finish end of the die to produce an axial displacement of blank material.

These and other aspects of this invention are disclosed more fully in the following description and drawings.

DETAILED DESCRIPTION OF THE DRAWINGS

Figure 4:
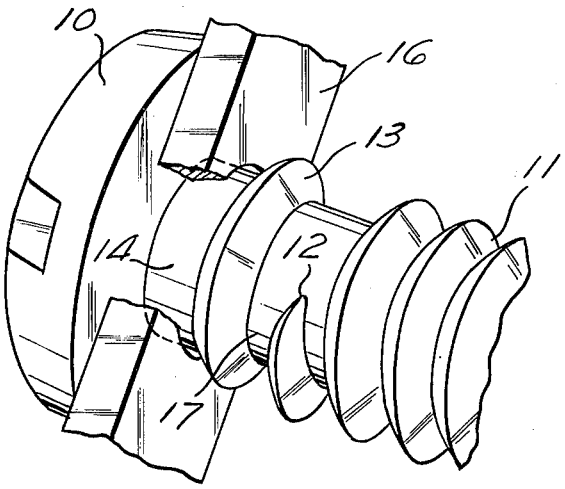
FIG. 4 is an enlarged prospective view of the head end of a fastener rolled by a die in accordance with FIGS. 1 through 3.
Figure 5:
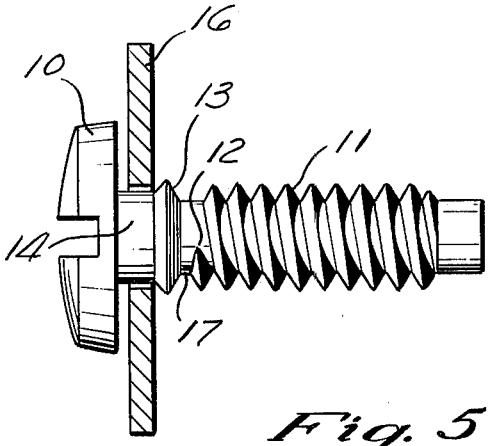
FIG. 5 is a side elevation of the fastener illustrated in FIG. 4.

FIGS. 4 and 5 illustrate a threaded fastener formed by a die and a method in accordance with the present invention. Such fastener is illustrated as provided with a typical slotted head 10 and a threaded shank 11. The threads on the shank 11 extend to an end at 12 spaced from the head 10. Located intermediate the head 10 and the ends 12 of the thread is an annular rib or ridge 13 which in the illustrated embodiment has a maximum diameter substantially equal to the major diameter of the threads 11. Between the rib 13 and the head 10 is an unworked cylindrical portion 14 which is the original diameter of the blank used to form the fastener. Located around the cylindrical portion 14 between the head and rib 13 is a washer or clip 16 of any suitable type. It should be understood that the particular form of the washer or clip forms no part of this invention and can be of any type desired.

As best illustrated in FIGS. 4 and 5 the end of the thread blends smoothly to the root diameter of the thread at 12 and the shank is formed with a groove 17 having a depth equal to the root diameter which extends from the end 12 of the thread to the rib 13.

As discussed in detail below the material required to form the ridge 13 is displaced from the zone of the groove 17 during the thread rolling process. It should be noted that the shank of the screw is free of any obstructions to the threading of the fastener into a mating threaded part until the mating threaded part reaches rib 13. Consequently, the member 16 can be used for example as a terminal to properly grip even relatively thin wire when a screw fastener with the terminal member 16 is threaded into the appropriate mating part.

Figure 1:
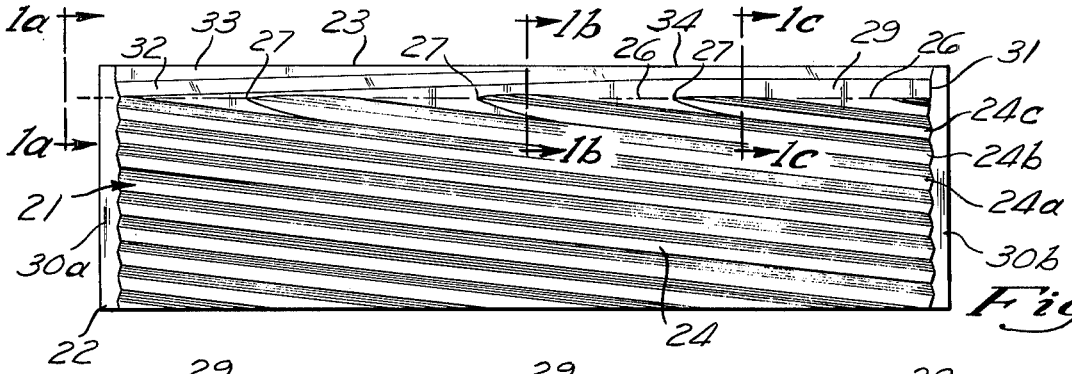
FIG. 1 is a plan view of one of a pair of flat dies incorporating the present invention.
Figure 2:
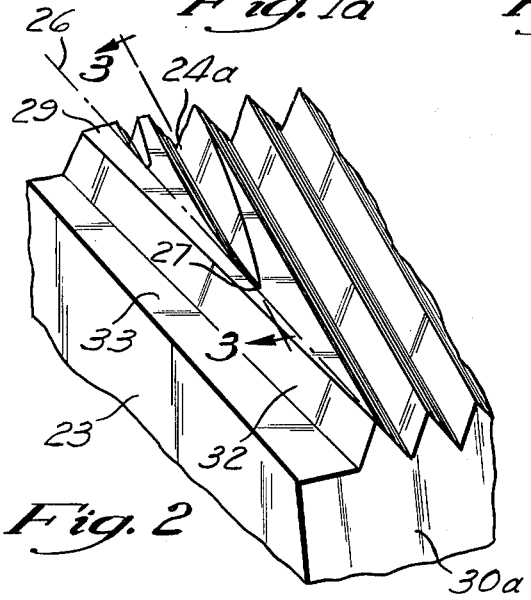
FIG. 2 is an enlarged fragmentary prospective view of the edge of the die illustrating the thread forming grooves and the ridge which functions to produce the annular rib.
Figure 3:
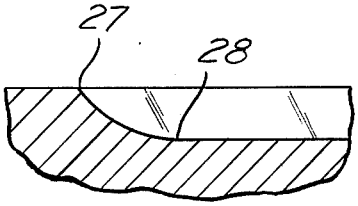
FIG. 3 is a fragmentary section taken along 3—3 of FIG. 2.

Referring now to FIGS. 1 through 3, a preferred die in accordance with the present invention is provided with a working face 21 on the die body 22. A lateral face 23 extends along one lateral edge of the body 22 and is the lateral face against which the washer or clip engages during the thread rolling operation. The working face 21 is formed with the usual thread forming groove 24 which are angulated with respect to the lateral face 23 at the thread lead angle of the thread to be formed by the die.

In the preferred die however, the grooves 24*a*, 24*b*, and 24*c* do not extend the full width of the working face. Instead such grooves extend to a base line 26 which is parallel to the lateral face 23 but spaced therefrom. At the base line the thread forming grooves 24*a* through 24*c* fade out as best illustrated in FIGS. 3 to zero depth at their ends 27. However, they have the conventional depth and configuration for the particular type of thread to be formed at all locations spaced from the fade out section between the point 27 and the point 28. Consequently, the end of the thread formed on the fastener blends to root diameter as best illustrated in FIGS. 4 and 5.

Figure 1A:
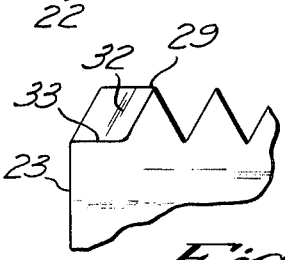
FIG. 1*a* is a fragmentary section taken along 1*a*—1*a* of FIG. 1.
Figure 1B:
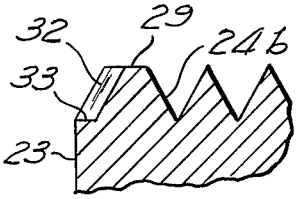
FIG. 1*b* is an enlarged fragmentary section taken along 1*b*—1*b* of FIG. 1.
Figure 1C:
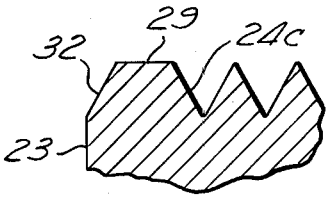
FIG. 1*c* is an enlarged fragmentary section taken along 1*c*—1*c* of FIG. 1.

Located between the base line 26 and the lateral face 23 is a ridge 29 which functions to form the groove 17 and rib 13. In the illustrated embodiment the ridge 29 is tapered from substantially zero width at the start end 30*a* of the die as best illustrated in section 1*a* and FIG. 2. The width of the ridge 29 progressively increases in width toward the finished end 30*b* of the die as illustrated by comparing FIGS. 1*b* and 1*c* with FIG. 1*a*. At the location of the section 1*c* the ridge is at its maximum width which continues to the finished end of the die at 31. Preferably the side of the ridge provides a surface 32 at an angle of about 60° with respect to the working face which extends from the top of the ridge 29 downwardly to a tapered bottom surface 33 parallel to the working face 21.

As best illustrated in FIG. 1 the surface 32 extends at a slight angle with respect to the long axis of the die until the point approximately at 34 is reached. Between the point 34 and the finished end of the die the surface 32 is parallel to the lengthwise axis of the die. Also the bottom surface 33 has a maximum width at the beginning end of the die and tapers to zero at the point 34.

As the blank being rolled engages the die the ridge 29 penetrates the blank material to the same depth as the thread forming grooves. As the blank rolls along the die the surface 32 causes a continuing axial force which moves the material of the blank axially of the blank to form the ridge 13. Therefore, substantially all of the material displaced from the groove 17 formed by the ridge 29 is moved into the rib 13 and there is no tendency for a second ridge to be developed at the ends of the threads themselves. It is recognized that this axial force may produce some limited elongation of the blank. However, for blanks formed of conventional materials the displacement of blank material into the ridge occurs with little axial stretching of the blank itself.

In instances in which the washer or clip has a sufficiently large diameter, it is preferable to extend the surface 32 all the way to the intersection of such surface with the plane of the lateral face 23 and it is not necessary to form the tapered bottom surface 33. On the other hand when the clip 16 is of a small diameter or is an elongated terminal type device, the structure best illustrated in FIGS. 2 is preferred since it insures that the washer is held up against the head as the blank is rolled by the dies.

The illustrated die functions to produce a clean uniform thread to the end 12 where the thread blends down into the root diameter of the blank and the material displaced during formation of the groove is moved axially of the blank to form the ridge 13. In practice it has been found that with the present invention a sufficiently large ridge 13 is formed to properly lock a washer or clip member 16 properly adjacent to the head 10 without jamming and that if desired, such ridge can be formed to have a diameter even larger than the major diameter of the threads. Further, the axial displacement produces a more sharply defined rib than devices which do not produce continued axial displacement as rolling progresses. In the illustrated fastener the ridge 13 has a maximum diameter substantially equal to the major diameter of the thread.

It should be understood that the present invention is not limited to flat dies of the type illustrated but that it is also applicable to rotary dies and arcuate dies. Also, it should be understood that although this invention is illustrated in conjunction with the manufacture of fasteners assembled with washers, clips or the like, that it is also applicable to the manufacture of fasteners which have ribs or shoulders for other purposes.

Although a preferred embodiment of this invention is illustrated it is to be understood that various modifications and rearrangements may be resorted to without departing from the scope of the invention disclosed and claimed.

I claim:

1. A thread rolling die comprising a die body formed with a working face and a lateral face along one edge of said working face extending from a start end to a finish end, said working face including the plurality of angulated thread forming grooves extending to a base line substantially parallel to and spaced from said lateral face where they fade to zero depth into a ridge having a height at least substantially as high as the crests of said grooves, said ridge being located between said base line and said lateral face and being operable to produce an annular groove in a workpiece at least substantially as deep as the roots of the threads and to form an annular rib on said workpiece which is spaced from the ends of the threads formed by said forming grooves.

2. A thread rolling die as set forth in claim 1 wherein sid ridge increases in width toward said finish end.

3. A thread rolling die as set forth in claim 2 wherein the side of said ridge adjacent said lateral side face is sloped toward said working face.

4. A thread rolling die as set forth in claim 3 wherein said side of said ridge extends from said working face to a location spaced from said working face where it intersects a bottom surface substantially parallel to said working face.

5. A thread rolling die as set forth in claim 4 wherein said bottom surface extends with decrease in width toward said finish end.

6. A thread rolling die as set forth in said claim 5 wherein said side face of said ridge extends to the same direction as said lateral face along the portion of said die adjacent said finish end.

7. A thread rolling die as set forth in claim 1 wherein the side of said ridge adjacent said lateral side face is sloped toward said working face.

8. A thread rolling die as set forth in claim 1 wherein said die is a flat die and said die body is substantially rectangular.

9. A thread rolling die as set forth in claim 1 wherein the side of said ridge adjacent said lateral side face is angulated toward said lateral side face in the direction toward said finish end.

10. A thread rolling die as set forth in claim 9 wherein said side of said ridge adjacent to said lateral side face is sloped toward said working face.

11. A thread rolling die as set forth in claim 1 for rolling headed fasteners with washers or the like adjacent to their heads wherein said lateral side face is proportioned to engage the side of the washer or the like opposite said head and said rib is formed on said side of said washer or the like.

12. A method of forming threaded fasteners having an annular rib substantially adjacent the end of threads thereon comprising rolling a blank against a die working face having thread forming grooves which fade in depth at their ends to produce threads which are tapered at their ends to substantially the root diameter of said thread, and displacing material of said blank to a depth of at least as deep as the roots of said threads from adjacent said ends axially of said blank to form an annular rib spaced from said ends.

13. A method of forming a threaded fastener as set forth in claim 12 wherein said displacement is produced by applying an axial force to a portion of the material adjacent to the surface thereof and continuing the application of said axial force as blank material is axially displaced into said rib.

* * * * *